US005897398A

United States Patent [19]

Maeda

[11] Patent Number: 5,897,398

[45] Date of Patent: Apr. 27, 1999

[54] POWER SOURCE PLUG

[75] Inventor: Hidekazu Maeda, Aichi, Japan

[73] Assignee: Sony Corporation, Tokyo, Japan

[21] Appl. No.: 08/867,098

[22] Filed: Jun. 2, 1997

[30] Foreign Application Priority Data

Jun. 3, 1996 [JP] Japan ..... 8-140219

[51] Int. Cl.[6] ..... H01R 13/04

[52] U.S. Cl. ..... 439/693

[58] Field of Search ..... 439/373, 636, 439/693

[56] References Cited

U.S. PATENT DOCUMENTS

| | | | |
|---|---|---|---|
| 2,226,148 | 12/1940 | Taylor | 439/693 |
| 3,543,218 | 11/1970 | Archer | 439/693 |
| 3,710,287 | 1/1973 | Eckert | 439/693 |

*Primary Examiner*—Khiem Nguyen
*Attorney, Agent, or Firm*—Jay H. Maioli

[57] ABSTRACT

A power plug having gap filling members for filling the space between the power plug terminals and the inner surfaces of the inlets of the power source receptacle, thereby providing a reliable and safe power plug.

7 Claims, 5 Drawing Sheets

POWER SOURCE PLUG

BACKGROUND OF THE INVENTION

1. Field of the Invention

The present invention relates to a power source plug inserted into a power outlet of a commercial power source, for example, a power source receptacle for supplying electric power to an electrical equipment, or more particularly a power source plug with a gap filling material formed therein for preventing a tracking fire (a fire caused by the short-circuiting or shorting due to the dust, dirt or the like deposited).

2. Description of the Related Art

Electrical equipment such as an electric appliance, an office automation equipment and so on each include a power source plug to be inserted into a power source receptacle for electrical connection. The connection terminal member of the power source plugs is slightly smaller in outer diameter than the inner diameter of a power source plug connection hole in order to permit insertion thereof into the power source plug connection hole of the power source receptacle. Consequently, when the power source plug is inserted into the power source receptacle, dust, dirt or the like attaches to the gap between the connection terminal member of the power source plug and the power source plug connection hole of the power source receptacle, thereby often causing a short-circuiting or other inconveniences.

When the power source plug is inserted into a power source receptacle, there is caused a gap formed between the connection terminal member and the power source, plug connection hole and hence is liable to become loose. The power source plug then easily tilts with respect to the power source receptacle and tends to come off easily from the power source plug connection hole. The power source plug thus would easily come off, if a leg is erroneously caught in a power source cord of the power source plug, for example. Especially with the office automation equipment or the like requiring incessant power supply, power would be interrupted by the coming-off of the power source plug, leading to the problem of the loss of the internal data thereof.

With the object of solving this problem, the specification entitled "Power source plug" disclosed in Japanese patent application No. 7-37388 filed earlier by the present applicant will be briefly explained as first and second prior applications with reference to FIGS. 1 and 2 showing the same.

A first prior art power source plug 1 comprises, as shown in FIG. 1, a plug body 3, a pair of connection terminal members 4A, 4B adapted to be inserted into power source plug connection holes 9A, 9B of a power source receptacle 2, and a power source cord 5 connected to an electrical equipment.

The plug body 3 has a profile thereof formed substantially rectangular and made of an insulating material having the insulating property like plastics or synthetic rubber or the like. Also, the plug body 3 is formed with a pair of gap filing members 6A, 6B integrally formed therewith upon its molding so as to be protruded from a butting surface 3A of the plug body 3 on which surface 3A the connection terminal members 4A, 4B are respectively inserted into power source plug insertion holes 9A and 9B of the power source receptacle 2.

These gap filling members 6A, 6B are formed in a rectangular cylinder having substantially the same outer diameter is the inner diameter of the power source plug connection holes 9A, 9B of the power source receptacle 2.

The gap filling members 6A, 6B, as shown in FIG. 2, include a pair of connection terminal insertion holes 7A, 7B each having an inner diameter substantially equal to the outer diameter of each of the connection terminal members 4A, 4B. Also, the gap filling members 6A, 6B are formed with chamfered portions 8A, 8B, respectively, at the tip ends thereof.

The connection terminal members 4A, 4B are made of a metal plate and, have the base end side thereof supported in the plug body 3, and the forward end portions thereof to be inserted into the power source plug connection holes 9A, 9B of the power source receptacle 2 are mounted on the plug body 3 so as to protrude from the connection terminal insertion holes 7A, 7B of the plug body 3. As a result, the outer peripheral walls of the roots of the connection terminal members 4A, 4B protruded from the plug body 3 are covered by the inner peripheral walls of the gap filling members 6A, 6B of the plug body 3, respectively.

With the first prior art power source plug 1 having the above-mentioned configuration, the connection terminal members 4A, 4B thereof are inserted into the power source plug connection holes 9A, 9B of the power source receptacle 2, respectively. Upon the insertion, the gap filling members 6A, 6B are filled the gaps 10A, 10B formed between the outer peripheral walls of the connection terminal members 4A, 4B of the power source plug 1 and the inner peripheral walls of the power source plug connection holes 9A, 9B of the power source receptacle 2. As a result, the gaps 10A, 10B disappear and hence dust, dirt or the like can not invade thereinto while at the same time preventing the loosening of the power source plug.

With the second prior art power source plug (not shown), on the other hand, gap filling caps (blade caps) are arranged separately from the plug body and therefore are detachable. By inserting the blade caps, the gaps are protected from intrusion of dust, dirt or the like.

In the above-mentioned first prior art power source plug 1, however, the gap filling members 6A, 6B are formed of the same material as and integrally with the plug body 3. Therefore, in the case where the plug body is made of a soft material such as vinyl chloride or the like, for example, the thickness of the gap filling members 6A, 6B is thin, thereby leading to the problem of a lower durability of the gap filling members 6A, 6B when they are inserted into the connection hales 9A, 9B of the power source receptacle 2.

With the second prior art power source plug, on the other hand, the blade caps are arranged so as to be detachable from the plug body formed separately. However, since the conventional blade caps have no means for connection with the plug body the inserted blade caps come off from the root of the plug body so that the connection terminal members 4A, 4B are exposed and thereby posing the threat of the intrusion of dust, dirt or the like in the gaps, in the case where a force is applied to depress the plug body down or in the case where the plug body is in a state liable to come off.

SUMMARY OF THE INVENTION

In view of such aspects, it is an object the present invention to provide a power source plug in which it possible to form gap filling members with excellent durability even for a power source plug formed of a soft material.

Another object of the invention is to provide a power source plug in which the blade caps lacking the connection means are prevented from coming off the plug body thereby to improve the safety thereof.

According to an aspect of the present invention, a power source plug which is to be inserted into a power source plug connection hole of a power source receptacle for electrical connection, includes a plug body made of an insulating material, a plurality of electrical connection terminals each of which is supported at its one portion in an inside of the plug body and is inserted at its rest portion protruded from the plug body into the connection hole of the power source receptacle, a gap filling member which is disposed at each of the electrical connection terminals for filling a gap between the electrical connection terminal and an inner surface forming the connection hole of the power source receptacle and which is formed independently of the plug body, and fixing means for fixing the gap filling member on the plug body.

DESCRIPTION OF THE PREFERRED EMBODIMENTS

A power source plug according to a first embodiment of the present invention will be described with reference FIGS. 3 and 4.

first embodiment

The power source plug according to a first embodiment of the present invention will be described with reference FIGS. 3 and 4. FIG. 3 is a diagram showing a cross section of a power source plug 11. FIG. 4 is a perspective view of the power source plug 11 and a power source receptacle 2.

Figure 3:
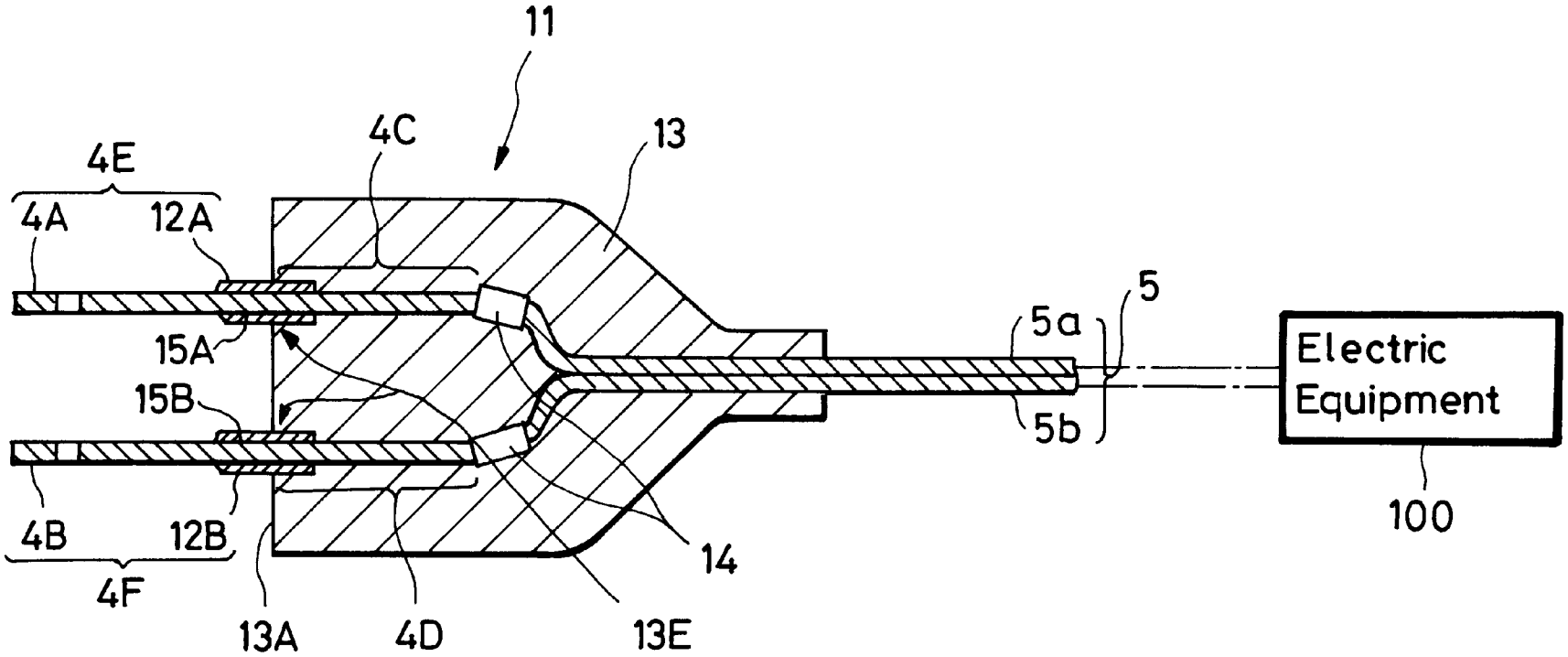
FIG. 3 is a diagram showing partially in cross-section a power source plug according to a first embodiment of the present invention.
Figure 4:
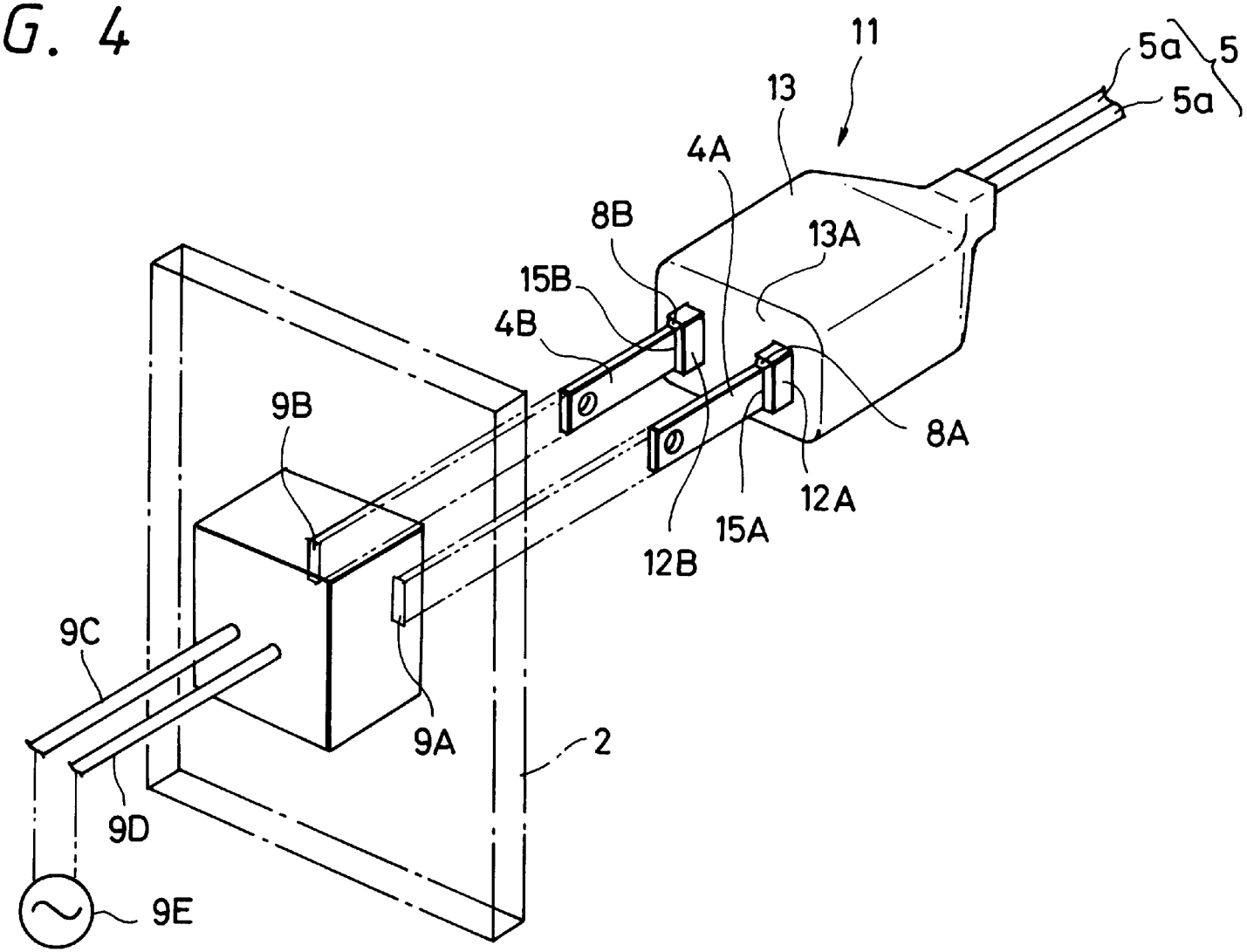
FIG. 4 is a perspective view showing the power source plug according to the first embodiment and a power source receptacle.

The power source plug 11 according to the first invention, as shown in FIGS. 3 and 4, comprises a plug body 13, a pair of connection terminal members 4A, 4B to be inserted into the power source receptacle 2, blade caps 12A, 12B inserted into the root portions of the connection terminal members 4A, 4B protruded from the plug body 13, a power source cord 5 connected to an electrical equipment 100, and caulked portions 14 for connecting the power source cord 5 and the connection terminal members 4A, 4B, respectively.

Figure 1:
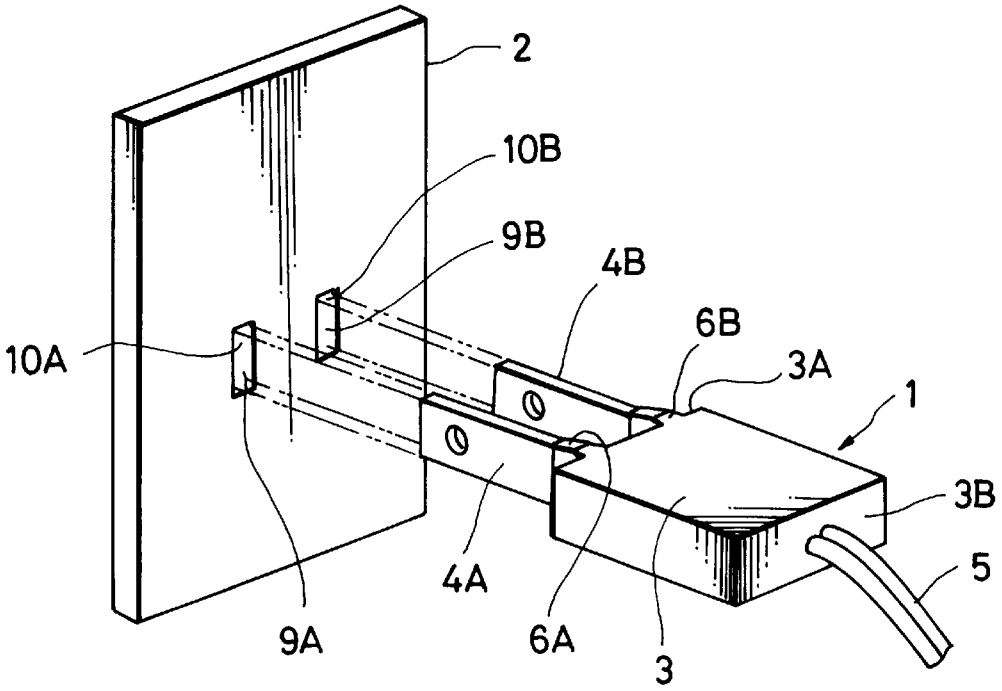
FIG. 1 is a diagram showing a power source plug.
Figure 2:
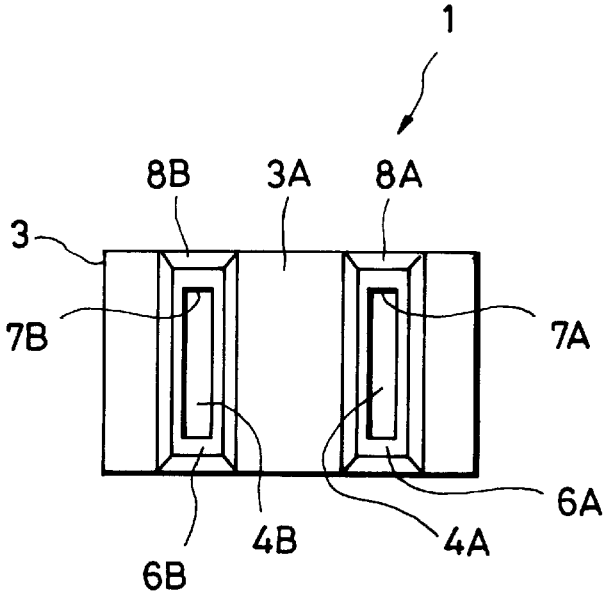
FIG. 2 is a plan view of the power source plug shown in FIG. 1.

A conventional power source receptacle can be used as the power source receptacle 2 of the present invention. The same power source receptacle as that described with reference to FIGS. 1 and 2 can be employed as the power source receptacle 2.

The plug body 13 is made of an insulating material, e.g., a plastic, preferably polyvinyl chloride (PVC) material or the like material and having a substantially rectangular contour in cross-section the plug body 13 comprises a fitting surface 13A from which a pair of connection terminal members 4A, 4B are protruded.

A pair of the connection terminal members 4A, 4B are each made of a metal plate, and parts 4C, 4D of the connection terminal members 4A, 4B are tightly supported by the plug body 13 therein. The respective parts 4C, 4D of the connection terminal members 4A, 4B are also connected to lines 5*a*, 5*b* of the power source cord 5 and by metal caulked portions 14, 14.

On the other hand, remaining portions 4E, 4F of the connection terminal members 4A, 4B are protruded from the fitting surface 13A of the plug body 13 as described above.

Blade caps 12A, 12B will be described next. The blade caps 12A, 12B are members used to fill and shut respective gaps formed between the connection holes 9A, 9B of the power source receptacle 2 and the remaining porions 4E, 4F of the connection terminal members 4A, 4B, respectively. The blade caps 12A, 12B can be made of a material such as polystyrene PS different from that of the plug body 13. The blade caps 12A, 12B made of polystyrene are hard members as compared with PVC forming the plug body 13.

Therefore, even if the gaps produced when the remaining portions 4E, 4F of the connection terminal members 4*a*, 4B are inserted into the inlets 9A, 9B of the power source receptacle 2 shown in FIG. 4 are filled by the blade caps 12A, 12B, respectively, the durabilities of the blade caps 12A 12B can be improved. The blade caps 12A, 12B are formed in a rectangular cylinder cross-section shape and have formed therethrough connection terminal insertion holes 15A, 15B having inner diameters substantially equal to the outer diameters of middle portions of the connection terminal members 4A, 4B.

Further, the blade caps 12A, 12B have the tip ends thereof formed with chamfering portions 8A, 8B (see FIG. 4), respectively. The reason for forming the chamfering portions 8A. 8B is to allow the blade caps 12A, 12B to be smoothly inserted into the inlets 9A, 9B of the power source receptacle 2, respectively, and to prevent the blade caps 12A, 12B from being damaged upon insertion.

As shown in FIGS. 3 and 4, the outer peripheral walls of the root portions of the remaining portions 4E, 4F of the connection terminal members 4A, 4B protruded from the plug body 13 are covered with the inner peripheral walls of the blade caps 12A, 12B fitted on the connection terminal members 4A, 4B.

The power source receptacle 2 shown in FIG. 4 has the two inlets 9A, 9B as described above which are connected to a commercial power supply 9E through electric wirings 9C, 9D. This commercial power supply E is an AC power supply having a predetermined voltage, for example.

A method of manufacturing the power source plug 11 will be described below.

The blade caps 12A, 12B made of an insulating material are fitted on the respective middle portions of the connection terminal members 4A, 4B. The base end sides 4C, 4D of the connection terminal members 4A, 4B respectively are connected to the wires 5*a*, 5*b* of the power source cord 5 through the caulked portions 14. Under this condition, the connection terminal members 4A, 4B and the blade caps 12A, 12B are integrally formed by loading a die with a resin made of polyvinyl chloride material or the like constituting the plug body 13, thus the connection terminal members 4A, 4B and the blade caps 12A, 12B are firmly united with the plug body 13. Specifically, when the plug body 13 is molded by a die, fixed portions 13E, of the plug body 13 serve as fixing means for fixing the connection terminal members 4A, 4B and the blade caps 12A, 12B.

In this way, the blade caps 12A, 12B are formed as the gap filling means on the connection terminal members 4A, 4B, with the result that the intrusion of dust, dirt or the like is prevented from intruding into the power source receptacle 2 thereby improving reliability, thus completing the power source plug 11 according to the first invention.

The power source plug 11 having the above-mentioned configuration according to the first invention is such that the connection terminal members 4A, 4B can be inserted easily into the power source plug connection holes or inlets 9A, 9B of the power source receptacle 2 described above. Further, the gaps formed between the outer peripheral walls of the connection terminal members 4A, 4B and the inner peripheral walls of the power source plug connection holes 9A, 9B at the time when the former is inserted into the latter are filled with the outer peripheral portions of the blade caps 12A, 12B.

As a result, the gaps formed between the outer peripheral walls of the connection terminal members 4A, 4B and the inner peripheral walls of the power source plug connection holes 9A, 9B are protected from intrusion of dust, dirt or the like, while at the same time reducing the loosening of the power source plug 11 relative to the power source receptacle 2. Consequently, the power source plug 11 according to the first invention is very safe and can supply electric power to the electrical equipment 100 connected at the end of the power source cord 5.

second embodiment

A power source plug according to a second embodiment of the present invention will be described with reference to FIGS. 5 to 8.

Figure 5:
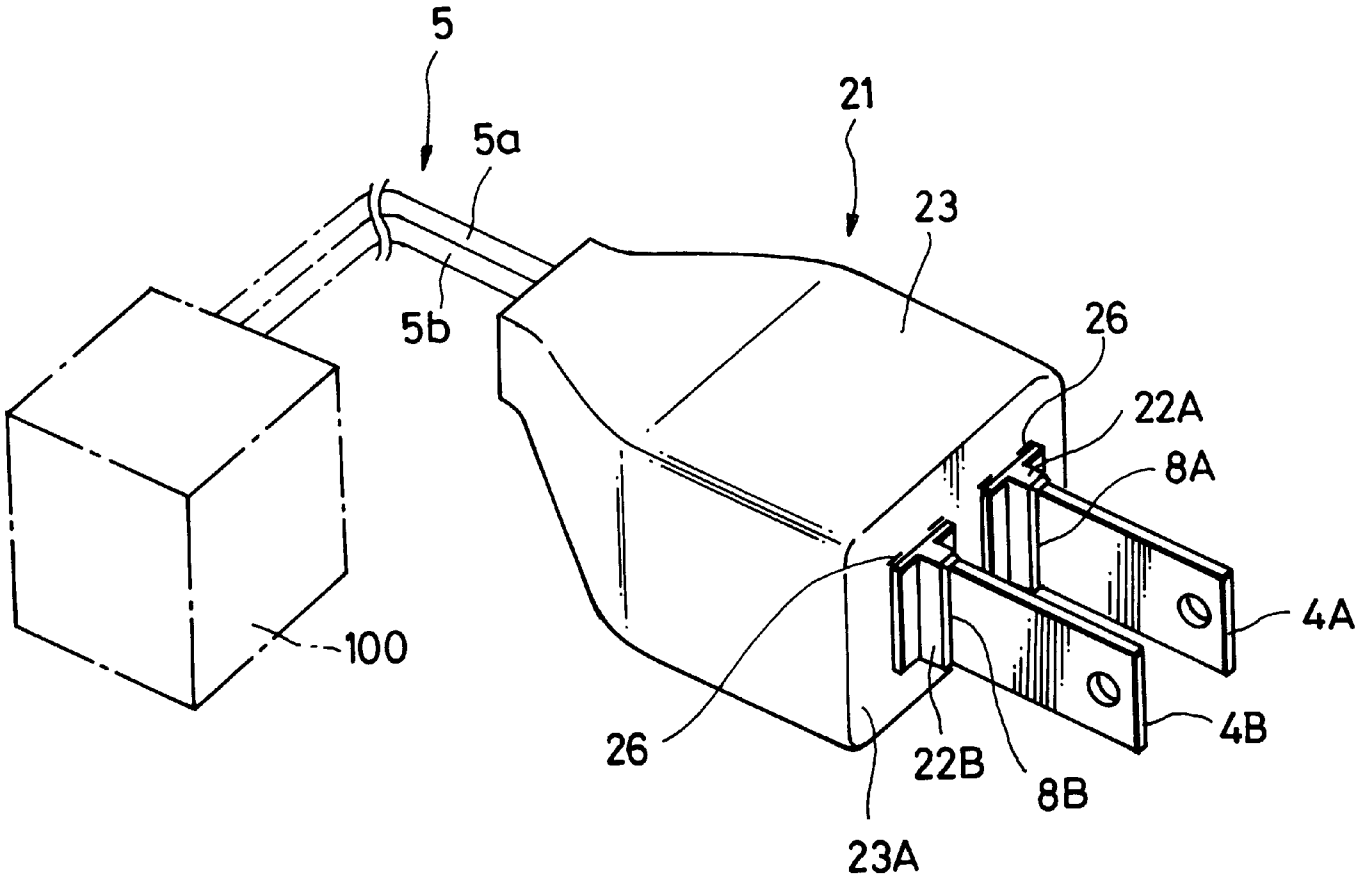
FIG. 5 is a perspective view showing a power source plug according to a second embodiment of the present invention.
Figure 6:
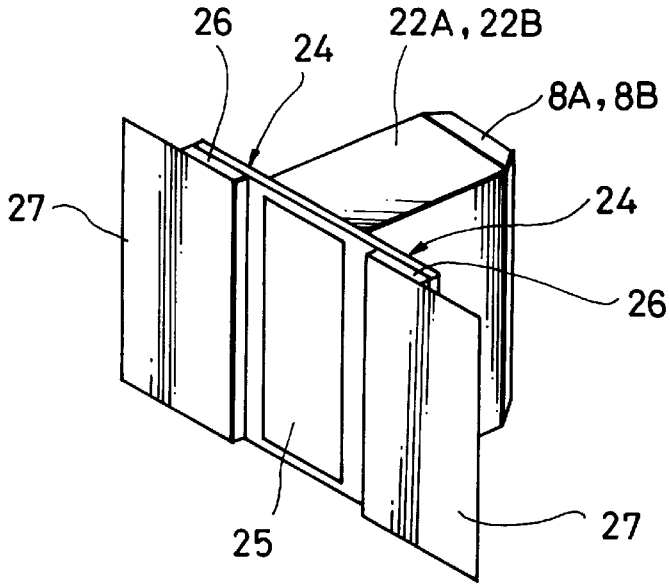
FIG. 6 is a perspective back view showing a blade cap to be inserted into the power source plug according to the second embodiment.
Figure 7:
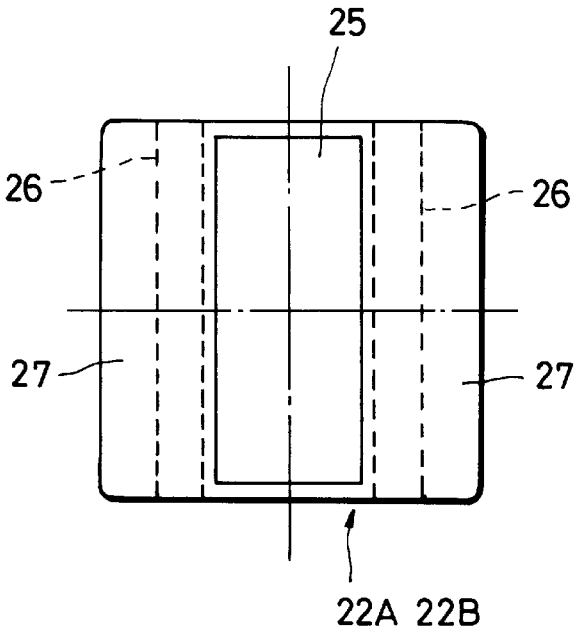
FIG. 7 is a front view of the blade cap to be inserted into the power source plugs according to the second embodiment.
Figure 8:
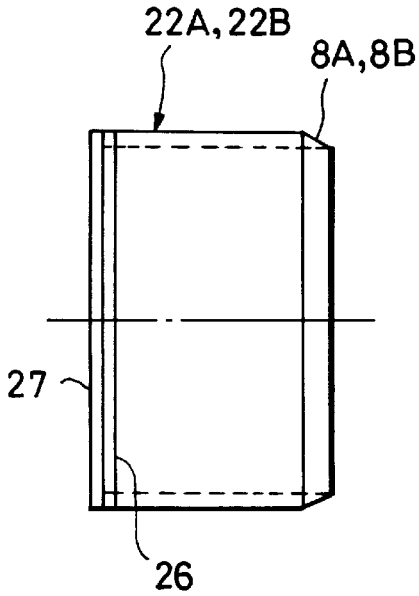
FIG. 8 is a side view of the blade cap shown in FIG. 6.

FIG. 5 is a diagram showing a power source plug 21 according to the second invention. FIG. 6 is a perspective view of the back portion of each of blade caps 22A, 22B to be fitted on the power source plug 21. FIG. 7 is a front view of the blade cap shown in FIG. 6. FIG. 8 is a side view of the blade cap shown in FIG. 6.

The power source plug 21 according to the second invention, as shown in FIG. 5, comprises an insulating plug body 23, a pair of connection terminal members 4A, 4B, and the blade caps 22A, 22B that can be coupled to the plug body 23 by being inserted into the root portions of the connection terminal members 4A, 4B protruded from a butting surface 23A of the plug body 13, as a feature of the second embodiment of the invention.

Each of the blade caps 22A, 22B of the present invention shown in FIGS. 6 to 8 is formed of an insulating material such as resin or the like, and has formed therethrough a connection terminal insertion aperture 25 to be inserted with each of the connection terminal members 4A, 4B, and also has a flange 24 constituting the connection means on a butting surface 23A (FIG. 5) side of the plug body 23. The flange 24 includes an adhesive paper 26 and a separable paper 27 for attaching each of the blade caps 22A, 22B to the plug body 23. Further, the blade caps 22A, 22B have the forward ends thereof formed with chamfered portions 8A, 8B for facilitating the insertion into the inlets 9A, 9B of the power source receptacle 2 shown in FIG. 4.

A method of manufacturing the power source plug 21 according to the second embodiment of the present invention will be described with reference to FIGS. 5 to 8.

The flanges 24 of the blade caps 22A, 22B each have the adhesive paper 26 having the separation paper 27 bonded thereto in advance. In actual applications of the blade caps 22A, 22B according to the present invention, the separable papers 27 are peeled off and the blade caps 22A, 22B are inserted into the connection terminal members 4A, 4B to the roots thereof in a matching state with the connection terminal insertion holes 25. Thus, the blade caps 22A, 22B are attached to the butted surface 23A of the plug body 23 using the adhesive papers 26.

Upon using the second power source plug 21 according to the second invention having the above-mentioned configuration, the outer peripheral portions of the blade caps 22A, 22B according to the present invention are inserted into the power source plug connection holes 9A, 9B of the mating power source receptacle 2 shown in FIG. 4. Also, since the blade caps 22A, 22B according to the invention are made of an insulating material, the connection terminal members 4A, 4B are not exposed even in the case where the power source plug 21 according to the present invention is liable to come off from the connection holes 9A, 9B of the power source receptacle 2.

As a consequence, the gaps formed between the outer peripheral walls of the connection terminal members 4A, 4B and the inner peripheral walls of the power source plug connection holes 9A, 9B are prevented from intrusion of dust, dirt or the like, while at the same time preventing the loosening of the power source plug 21 relative to the power source receptacle 2. Therefore, the power source plug 21 according to the present invention can supply electric power to the electrical equipment 100 reliably and safely.

A method of connecting the blade caps 22A, 22B to the plug body 23 according to the present invention was explained above with reference to the adhesive paper 26 as an example. Nevertheless, another connection means such as an adhesive or the like can of course be used in place of the adhesive paper.

According to the embodiments of the present invention, the tracking fire or the short-circuiting can be avoided due to the attachment of dust, dirt or the like to the connection terminal members.

Even if the plug body is formed of a soft material, the blade caps can be formed of a different hard material, and a power source plug with a gap filling member with an improved service life thus is realized.

According to the power source plug according to the second embodiment, the blade caps are provided as members independent of the plug body, and therefore the blade caps can be fitted on a normal power source plug at a later time thereby maintaining the safety of the power source plug.

Also, since the blade cap according to the present invention is attached to the plug body by the adhesive paper or adhesive, an electrocution or the like accident can be prevented due to the configuration in which the conductive portions of the connection terminal members are not exposed even when an infant or an operator touches the root of the power source plug by mistake.

While the power source plug is described in the above embodiments, it is needless to say that the present invention can be applied to any electric equipment using a power source plug of the present invention and to a power plug equipped with a connection terminal member such as an AC/DC conversion adaptor, table tap or the like. While the power source plug has two connection terminal members in the above embodiments, the power source plug may have one or three or more connection terminal members.

Even if the plug body is formed of a soft material, the gap filling member having an excellent durability can be provided therein, and hence it is possible to improve safety by preventing the gap filling member from being detached.

Having described preferred embodiments of the present invention with reference to the accompanying drawings, it is to be understood that the present invention is not limited to the above-mentioned embodiments and that various changes and modifications can be effected therein by one skilled in the art without departing from the spirit or scope of the present invention as defined in the appended claims.

What is claimed is:

1. A power plug for mating with a power source receptacle forming an electrical connection, comprising:

a plug body made of a plastic insulating material having a selected hardness;

two electrical connection terminals, wherein each of said two electrical connection terminals is supported at a first portion inside said plug body, so that a second portion protrudes from said plug body for insertion into said power source receptacle;

two individual gap filling members respectively disposed on said two electrical connection terminals adjacent said first portion of each of said two electrical terminals for filling a gap between each of said two electrical connection terminals and an inner surface of an inlet of said power source receptacle, wherein said gap filling member is formed independently of said plug body and of a plastic material having a hardness greater than the hardness of said plug body; and fixing means for fixing said two gap filling members on said plug body.

2. The power source plug according to claim 1, wherein said fixing means fixes said gap filling member onto said plug body.

3. The power source plug according to claim 1, wherein said fixing means is an adhesive member for bonding said gap filling member on said plug body.

4. The power source plug according to claim 3, wherein said adhesive member is an adhesive sheet.

5. The power source plug according to claim 3, wherein said adhesive member is an adhesive.

6. An electric equipment being supplied with electric power by inserting a power source plug into an inlet of a power source receptacle, comprising:

a power source plug, comprising a plug body made of a plastic insulating material having a selected hardness, two electrical connection terminals, wherein each of said two electrical connection terminals is supported at a first portion inside said plug body and a second portion protrudes from said plug body for insertion into said power source receptacle, two individual gap filling members respectively disposed at said two electrical connection terminals for filling a gap between each of said two electrical connection terminals and an inner surface of an inlet of said power source receptacle, wherein each of said two gap filling members is formed independently of said plug body of plastic material having a hardness greater than the hardness of said plug body and each of said two gap filling members extends over part of both of said first portion and said second portion of said electrical connection terminal, so that a portion of each gap filling member is embedded in said plug body.

7. A power plug manufacturing method, wherein the power plug mates with a power source receptacle forming an electrical connection, comprising the steps of:

disposing two individual gap filing members at two electrical connection terminals for filling gaps between said electrical connection terminals and inner surfaces of inlets of the power source receptacles; and molding integrally a plug body so that portions of said two electrical connection terminals and of said two gap filling members are embedded in said plug body, including forming said gap filling members of a plastic material having a hardness greater than a hardness of said plug body formed of a plastic material with a predetermined hardness.

* * * * *